US011299683B2

(12) United States Patent
Chen et al.

(10) Patent No.: US 11,299,683 B2
(45) Date of Patent: Apr. 12, 2022

(54) LIQUID FUEL

(71) Applicants: Shu-min Chen, Beijing (CN); Hung-lin Chen, Beijing (CN)

(72) Inventors: Hunglin Chen, Beijing (CN); Shumin Chen, Beijing (CN)

( * ) Notice: Subject to any disclaimer, the term of this patent is extended or adjusted under 35 U.S.C. 154(b) by 118 days.

(21) Appl. No.: 17/253,478

(22) PCT Filed: Sep. 25, 2017

(86) PCT No.: PCT/CN2017/103211
§ 371 (c)(1),
(2) Date: Dec. 17, 2020

(87) PCT Pub. No.: WO2019/056382
PCT Pub. Date: Mar. 28, 2019

(65) Prior Publication Data

US 2021/0163836 A1 Jun. 3, 2021

(51) Int. Cl.
*C10L 1/04* (2006.01)

(52) U.S. Cl.
CPC ..... *C10L 1/04* (2013.01); *C10L 2200/0423* (2013.01); *C10L 2200/0476* (2013.01); *C10L 2230/04* (2013.01)

(58) Field of Classification Search
CPC ..... C10L 1/04; C10L 1/08; C10L 2200/0423; C10L 2200/0476; C10L 2230/04
See application file for complete search history.

(56) References Cited

U.S. PATENT DOCUMENTS

2004/0250466 A1* 12/2004 Fang ..... C10L 1/08 44/388

FOREIGN PATENT DOCUMENTS

WO WO-2017049561 A * 3/2017 ..... C10L 1/04

OTHER PUBLICATIONS

W02017049561 Description Translated; (Mar. 2017) (Year: 2017).*

* cited by examiner

*Primary Examiner* — Ellen M McAvoy
*Assistant Examiner* — Chantel L Graham

(57) ABSTRACT

A liquid fuel obtained by blending heavy oil by selectively introducing hydrocarbon substances. The liquid fuel consists of a light oil component consisting of C6-C12 alkane, a catalytic component consisting of C13-C16 alkane, and a heavy oil component. On the basis of the liquid fuel, the mass fraction of the heavy oil component is 10%-90%, the mass fraction of the light oil component is 0-49%, and the mass of the catalytic component accounts for 86% or more of the mass of the light oil component; and the liquid fuel may also contain an aromatic hydrocarbon having a mass fraction of 0-15%. The obtained liquid fuel has good driving performance, combustion performance and safety, and can be applied to a diesel engine system, a diesel/heavy oil combustion system, etc., as a mixed fuel oil.

18 Claims, No Drawings

LIQUID FUEL

PRIORITY APPLICATION

This application claims the benefit of and priority to International Patent Application No. PCT/CN2017/103211, filed Sep. 25, 2017, the entire contents of which are incorporated herein by reference.

TECHNICAL FIELD

The present application relates to a liquid fuel obtained by mixing heavy oil with appropriate proportion of hydrocarbons, which has good driving performance, combustion performance and safety, and belongs to the field of fuel technology. The liquid fuel can be applied to diesel engine system and diesel/heavy oil combustion system as a mixed fuel oil.

BACKGROUND

The industrial combustion system is mainly based on heavy oil, which has the characteristics of low price and good safety. However, conventional diesel/heavy oil fuel is still extracted from petroleum raw materials. Under the condition of declining global crude oil reserves and refining capacity, it is an urgent need for modern industry to try to fill the increasing supply gap with some renewable raw materials (such as waste plant oil or animal oil).

Different alternative fuels from different perspectives have been looked in the existing technologies. For example, Chinese patent CN101321849A discloses an alternative fuel formulation, which selects plant oil mono-alcohol esters, C5-C11 olefins and C2-C8 alcohols as the main components to obtain an alternative fuel for diesel engine. The alternative fuel has a cetane number similar to diesel oil, and its flash point and density are similar to those of diesel oil. The alternative fuel shows good starting properties at low temperature. However, the alcohols and olefins in the alternative fuel need to be synthesized by Fischer-Tropsch process, which limits the source of raw materials and costs relatively high.

Another example, Chinese patent CN101469282A discloses a biodiesel composition consisting of 25%-65% diesel, 5%-35% solvent oil, 10%-25% gasoline, 10%-20% alkane, 5%-15% kerosene, and the balance of rapeseed oil, gutter oil, plant oil, animal oil or other oils. However, although the diesel oil alternative formulation is obtained in the above composition, the solvent oil and kerosene used in the formulation are not selected and cut, which contains a large number of heavy alkanes, and its flash point temperature is difficult to meet the market access standards of most countries and regions.

Through numerous research and experiments, the inventor of this present application found that by selecting and cutting the fuel composition, mixing the light oil component composed of C6-C12 alkane, the catalytic component composed of C13-C16 alkane and the heavy oil component can obtain a alternative liquid fuel for diesel oil. The liquid fuel has good combustion performance and safety, and can meet the application of various diesel equipments. This technology has been applied to PCT international application WO2017049561A1.

On the basis of the above liquid fuel formula, the inventor of the present application further adjusts and improves the proportion of each component. It is found that increasing the proportion of the catalytic component composed of alkanes of C13-C16 and taking the catalytic component as the main component can further improve the flash point property of the alternative fuel, have better combustion performance, and make various technical parameters and indexes of the liquid fuel meet the requirements in China, Europe and other major market access standards, with a wider range of market value.

SUMMARY

The present application provides a liquid fuel, which has good combustion performance and safety by adjusting the liquid fuel components, and can meet the application of various diesel equipments.

The present application provides a liquid fuel, which comprises light oil component composed of C6-C12 alkanes, catalytic component composed of C13-C16 alkanes, and heavy oil component; On the basis of the liquid fuel, the mass fraction of the heavy oil component is 10%-90%, the mass fraction of the light oil component is 0-49%, the mass fraction of the catalytic component is 10%-90%, and the mass of the catalytic component accounts for 86% or more of the mass of the light oil component; and the liquid fuel may also contain an aromatic hydrocarbon having a mass fraction of 0-15%.

The present application provides a liquid fuel which is a blended fuel. By selecting an appropriate proportion of light oil component and catalytic component, the poor combustion performance of heavy oil fuel is solved, and the safety of fuel oil is significantly improved. Specifically, the liquid fuel provided by the present application has the following four advantages:

1. Adding the catalytic component of C13-C16 alkanes and the heavy oil component into the light oil component of C6-C12 alkanes, according to the appropriate proportion, to further improve the flash point of the liquid fuel;

2. The light oil component is first mixed with the catalytic component to obtain a mixture with improved flash point, which effectively improves the safety of the raw material for making the liquid fuel during the process of transportation and storage;

3. The addition of catalytic component increases the compatibility of the heavy oil component and light oil component, and prevents separation of the heavy oil component and light oil component in the liquid fuel from forming a poor dissolution interlayer;

4. By adding appropriate proportion of catalytic component, the gasification and combustion process of the liquid fuel is smoother, and deflagration occurs in a smooth way to provide power, without adverse knocking.

In particular, the present application provides the liquid fuel containing heavy oil, that is, a high-quality diesel alternative fuel is obtained by using the low-cost heavy oil component. In a specific embodiment, the mass content of the heavy oil component is 10%-90% based on total mass of the liquid fuel, could either be 30 mass %-90 mass %, or 60 mass %-80 mass %. It makes the liquid fuel which utilizes inferior resources becoming a high quality fuel.

In the embodiments of the present application, the addition of the catalytic component is crucial to the property of the liquid fuel. Choosing the appropriate proportion of the catalytic component can make the catalytic component and light oil component or heavy oil component have a favorable synergistic effect, effectively improve the flash point of fuel mixture and ensure smooth combustion, so as to take into account the good starting performance and safety.

The liquid fuel of the present application can replace various diesel products currently used as diesel engine fuel (used for high, medium and low speed diesel engines by adjusting its cetane number) and diesel/heavy oil combustion system fuel. In particular, it can be used as a alternative fuel for vehicle diesel and aviation kerosene, as well as aviation jet turbine fuel.

DETAILED DESCRIPTION

The present application provides a liquid fuel, which includes light oil component composed of C6-C12 alkanes, catalytic component composed of C13-C16 alkanes, and heavy oil component. The light oil component improves the fuel performance of the liquid fuel, while adding an appropriate proportion of catalytic component is conducive to further improving the flash point of the liquid fuel, so as to meet the set safety standard.

The components of the liquid fuel, wherein the light oil component can come from common petroleum raw materials such as cracking gasoline, reforming gasoline, etc., and it is purified by cutting process to become C6-12 alkanes components, whereas remove those not meeting the required cetane number (C16+) and select the suitable alkanes to form light oil component. For convenience of description, the alkane compositions of C13-C16 are called "catalytic component", and the catalytic component can come from paraffin kerosene and other commonly used petroleum materials. The petroleum raw material is purified by cutting process to become C13-C16 alkanes components, whereas move those not meeting the required cetane number (C16+) and select the suitable alkanes to form the catalytic component. The mass content of the light oil component is 0-49% based on total mass of the liquid fuel, and the mass of the catalytic component accounts for more than 86% of the mass of the light oil component.

Within the mass content range of the catalytic component, the specific content of catalytic component can be subject to the closed cup flash point of the final fuel meeting the requirements. To meet the market access standards of most regions, the liquid fuel of the present application has a closed cup flash point greater than 47° C., more preferably a closed cup flash point greater than 49° C. In the specific implementation scheme, the influence of catalytic component on the flash point of light oil component can be determined first, and then the flash point of final liquid fuel can be further determined, so as to obtain the reasonable proportion of each component. In general, the closed cup flash point of the light oil component mixed with the catalytic component is greater than 47° C., more preferably, the closed cup flash point of the light oil component after mixing with the catalytic component is greater than 48° C. In addition, without adding the light oil component (i.e., the mass content of the light oil component is 0%), the catalytic component is directly mixed with the heavy oil component to obtain the final liquid fuel with closed cup flash point could greater than 85° C. The final liquid fuel has excellent combustion performance and safety.

According to the implementation scheme of the present application, there is no special limit on how to allocate each component. For example, the light oil component and the catalytic component are mixed first, and then the heavy oil component is mixed. Or the selected components are mixed together according to the respective content proportion, so that obtained the liquid fuel meets the required flash point standard. Finally, it is reflected in the selection of appropriate amount of light oil component and catalytic component to make the closed cup flash point of the liquid fuel meets the relevant standards as an important index of its safety.

In the specific implementation scheme, the mixture of the light oil component and the catalytic component has a closed cup flash point higher than 47° C., at this time, the mass of the catalytic component accounts for 86%-1000% of the mass of the light oil component, or could be 86%-500%. Adding the above mixture into heavy oil component, the closed cup flash point can reach 48° C. or more; the light oil component and catalytic component mixture has a closed cup flash point higher than 47° C. the mass of catalytic component accounts for either 100%-500% or 300%-500% of the mass of the light oil component. The mixture of the light oil component and the catalytic component after blending the heavy oil, the final fuel can have a closed flash point above 48° C. When the light oil component is 0 mass % based on total mass of the liquid fuel, the mixture of catalytic component and heavy oil component has a closed cup flash point could higher than 85° C.

In the specific implementation scheme, the mass of the catalytic component accounts for 300%-500% of the mass of the light oil component, which is more conducive to ensuring the expected safety of the liquid fuel and controlling the cost performance ratio of the final liquid fuel. The catalytic component and the light oil component can be obtained by careful selection or it can be obtained by using the cut fractions from petroleum processing chain.

In a specific implementation scheme, the mass content of the light oil component in the fuel is 5% based on total mass of the liquid fuel, the mass of the catalytic component accounts for 500% of the mass of the light oil component, the mass content of the catalytic component in the fuel is 25% based on total mass of the liquid fuel, and the total content of the light oil component and the catalytic component in the fuel is 30% based on total mass of the liquid fuel.

As an essential component in the liquid fuel of the present application, the catalytic component composed of alkanes of C13-C16 can include a single alkane with 13-16 carbons or a mixture of more than one of them. The catalytic component composed of alkanes of C13-C16 comprises one or more of normal alkanes with 13-16 carbons and isomeric alkanes with 13-16 carbons and cycloalkanes with 13-16 carbons.

In the embodiment of the present application, the light oil component composed of the alkanes of C6-C12 can be a single alkane with 6-12 carbons or a mixture of more than one of them.

More specifically, the light oil component composed of C6-C12 alkanes includes one or more of normal alkanes with 6-12 carbons and isomeric alkanes with 6-12 carbons and cycloalkanes with 6-12 carbons. For example, the light oil component can be hexane, heptane, octane, nonane, decane, undecane and dodecane, which can reduce the octane number of liquid fuel and increase the cetane number. The liquid fuel can be used in diesel engine and diesel/heavy oil combustion system instead of diesel oil to achieve the effect of high calorific value, low pollution and low cost.

As mentioned above, the liquid fuel of the present application is prepared by adding appropriate proportion of catalytic component and/or light oil component on the basis of heavy oil component. Based on the total mass of the liquid fuel, the mass content of the heavy oil component is 30%-90%, or could be 60%-80%.

The liquid fuel of the present application comes from the reasonable blending product of hydrocarbon components and heavy oil components with different requirements for carbon structure. The hydrocarbon compounds as light oil component and catalytic component can be synthetic products, but they are usually refined products of raw oil purification, such as the solvent oils meeting the requirements. In the refining process, aromatics contained in the raw oil are generally toluene/xylene/ethylbenzene/propylbenzene/butylbenzene/pentylbenzene are considered to be impurities that need to be removed as much as possible. The cleaner the aromatics are removed, the higher the processing cost of raw oil will be, which must be reflected in the cost of fuel products.

The inventor's research found that heavy oil, especially animal and plant oil, has low calorific value due to its oxygen-containing structure, which is bound to affect the thermal effect of the liquid fuel. However, when the liquid fuel contains an appropriate amount of aromatics, it will not only have no obvious effect on the combustion effect, but also sometimes even show some improvement. Therefore, when preparing the fuel oil of the present application, it is allowed that the component oil used is not subject to strict dearomatization and purification. For example, the crude gasoline fraction often contains a certain amount of aromatics. As long as the aromatics content in the final liquid fuel is not more than 15%, it is not necessary to further refine and remove, so as to greatly reduce the purity requirements of the raw oil (light oil component and catalytic component) and broaden the raw oil's sources and selection. By choosing this way, the cost of liquid fuel as the final product is reduced. Considering the combustion effect, the inventor thinks that the fuel can contain a small amount of aromatics, such as toluene/xylene/ethylbenzene/propylbenzene/butylhenzene/pentylbenzene, etc., and the content of aromatics should be controlled within 3%-15%, in the specific scheme, according to the property parameters of each type of component oil, if a small amount of aromatics is really needed in the liquid fuel product, the low-carbon aromatic component can be introduced into the selected light oil component or the final fuel to improve the calorific value of the liquid fuel. The light oil component and catalytic component can come from the cut fractions from the petroleum processing chain, which can be more suitable for industrial production. For example, the crude gasoline fraction often contains certain aromatics and needs to be refined and removed, but it may be used as the light oil component of the liquid fuel of the present application. And such as C8-12 solvent oil or other equivalent distillate oil, all of which contain certain aromatics hydrocarbons, such as toluene/xylene/ethylhenzene/ipropylbenzene/butylbenzene/pentylbenzene, etc., are used in the liquid fuel of the present application without removal, which not only reduces the cost of raw materials, but also improves the calorific value of the fuel by the presence of a small amount of aromatic hydrocarbons. The same is true for the selection of catalytic component with appropriate distillation range, such as C13-16 solvent oil or other equivalent distillates.

The present application provides a liquid fuel, in essence, selecting suitable proportion of high volatile catalytic component and/or light oil component as solvent, dissolving and blending heavy oil component, so as to improve the volatility of heavy oil and reduce the viscosity, so as to become a liquid fuel with excellent combustion performance. The introduction of appropriate proportion of catalytic component can not only ensure the combustion performance of the liquid fuel, but also improve its safety, which is helpful to enter the fuel oil market as an alternative fuel for diesel engine. In this sense, the present application can be regarded as the development and extension of the inventor's persistent research achievements for many years.

In the implementation scheme of the present application, the heavy oil component can include waste engine oil, biodiesel (generally refers to fatty acid methyl ester/ethyl ester), biological oil (such as animal and plant oil) and its derivatives or a combination of more than two kinds. It can be simply understood as a common waste oil, such as the choice to use biological oil and its derivatives, which can include animal oils (such as from chickens, ducks, fish, cattle, sheep, pigs and other animals) or vegetable oils (such as soybean oil, palm oil, rapeseed oil, cottonseed oil, rice bran oil, jatropha curcas oil, sapindus oil, etc.) and their derivatives, and/or restaurant waste oil (commonly known as "gutter oil").

The present application also provides the use of the liquid fuel as the engine fuel of the diesel engine, in particular, the liquid fuel can be used as a fuel instead of vehicle diesel or aviation kerosene. For example, by adjusting the cetane number of the final product, it can be applied to all kinds of diesel engine fuel, specifically, the cetane number of the liquid fuel is more than 40, which is used for the high-speed diesel engine fuel; the cetane number of the liquid fuel is more than 30, which is used for the medium-speed diesel engine engine fuel; or, the cetane number of the liquid fuel is lower than 30 for low-speed diesel engine engine fuel.

The present application also provides the use of the liquid fuel as the fuel of the diesel/heavy oil combustion system.

The present application also provides the application of the liquid fuel as aviation jet turbine fuel.

The liquid fuel of the present application comes from the blending of heavy oil, catalytic component and/or light oil component, showing the combustion characteristics of gasoline and kerosene. In the simplest experiment, for example, the liquid fuel is ignited in the cylinder, the simulated combustion experiment is carried out, and the cylinder pressure heat release curve is measured. The obtained heat release curve of cylinder pressure shows a smooth single peak curve, which indicates that the liquid fuel gasifies smoothly and has no knock phenomenon during combustion. The effect can also be explained by the characteristics of the component oil used. The catalytic component can regulate the flash point of the mixture. After catalytic component mixing with the heavy oil component and/or the light oil component, the heavy oil component and/or light oil component can form a more homogeneous mixture, avoiding the occurrence of phase separation; at the same time, the addition of catalytic component makes the gasification process of liquid fuel mixture more convenient and smooth. After the fuel is injected into the cylinder, the fuel instantly gradually passes through the early flame diffusion period, high-speed flame propagation period and flame termination period. The addition of catalytic component makes the cylinder pressure heat release curve present a smooth single-peak curve without sudden knocking.

It can be said that the liquid fuel of the present application can replace diesel oil for various diesel engines, which not only has the advantages of complete combustion, low pollution and even no pollution. The introduction of appropriate proportion of light oil component and catalytic component can enhance the safety of the liquid fuel, so that the blended fuel with heavy oil component as matrix can replace diesel for diesel engine, which provides more guarantee in terms of technology and market access. As a clean and cheap substitute for diesel, it can make up for the weakness of petroleum diesel in regards of resources and cost.

The present application is further described through specific embodiments, but it can not be understood as the limitation of the protection scope of the present application.

Unless otherwise specified and defined, the content and proportion of all components involved in the present application are mass content and mass ratio.

EXAMPLES

Example 1

The components of liquid fuel are as follows:

Light oil component: from heavy straight run naphtha with distillation range of 100-220° C. After distillation and purification, the component is C8-C12 alkanes, which contains a small amount of mixed aromatics mainly composed of toluene/xylene/ethylbenzene/propylbenzene/butylbenzene/pentylbenzene etc., with aromatic content of about 5-10 mass %; C6-C12 alkalies mainly includes C6-C12 normal alkane, C6-C12 isoalkane and C6-C12 cycloalkane;

Catalytic component: from petroleum refined kerosene with distillation range of 200-300° C. After distillation and purification, its composition is determined to be C13-C16 alkanes, containing a small amount of mixed aromatics. The mixed aromatics can contain toluene/xylene/ethylbenzene propylbenzene/butylbenzenel pentylbenzene, etc., and the aromatic content is about 8-15 mass %; C13-C16 alkanes mainly include C13-C16 normal alkalies, C13-C16 is oalkanes and C13-C16 cycloalkanes.

Heavy oil component: cottonseed oil.

Catalytic component/light oil component=300% (mass ratio), and the closed cup flash point of blended oil is higher than 47° C. According to the total mass of the final liquid fuel composition, 80 mass % of the heavy oil component, 5 mass % of the light oil component and 15 mass % of the catalytic component are mixed to obtain the liquid fuel composition of the present application, and the closed cup flash point is greater than 48° C. The final liquid fuel mixture can contain 0-15 mass % aromatics.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

Example 2

Light oil component: from heavy cracked naphtha with distillation range of 150-220° C. After distillation and purification, the component is C9-C12 alkanes, which contains a small amount of mixed aromatics mainly composed of toluene/xylene/ethylbenzene/propylbenzene/butylbenzene/pentylbenzene, with aromatic content of about 5-10 mass %; C9-C12 alkanes mainly includes C9-C12 normal alkane, C9-C12 isoalkane and C9-C12 cycloalkane;

Catalytic component: from petroleum refined kerosene with distillation range of 200-300° C. After distillation and purification, its composition is determined to be C13-C16 alkanes, containing a small amount of mixed aromatics. The mixed aromatics can contain toluene/xylene/ethylbenzene/propylbenzene/butylbenzene/pentylbenzene, and the aromatic content is about 8-15 mass %; C13-C16 alkanes mainly include C13-C16 normal alkanes, C13-C16 isoalkanes and C13-C16 cycloalkanes.

Heavy oil component: soybean oil.

Catalytic component/light oil component=500% (mass ratio) and the closed cup flash point of blended oil is higher than 47° C. According to the total mass of the final liquid fuel composition, 70 mass % of the heavy oil component, 5 mass % of the light oil component and 25 mass % of the catalytic component are mixed to obtain the liquid fuel composition of the present application. The closed cup flash point is greater than 48° C. according to the total mass of the final liquid fuel composition. The final liquid fuel mixture can contain 0-15 mass % aromatics.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

Example 3

Component of light oil: from C6-C12 solvent oil, after distillation and purification, the component is C6-C12 alkanes, which contains a small amount of aromatics, and the content of aromatics is about 15 mass % C6-C12 alkanes include C6-C12 normal alkalies, C6-C12 isoalkanes and C6-C12 cycloalkanes;

Catalytic component: it is derived from C13-C16 heavy solvent oil, After distillation and purification, its composition is determined to be C13-C16 alkanes with a small amount of aromatics. The mixed aromatics can contain toluene/xylene/ethylbenzene/cumene/butylbenzene/pentylbenzene, with aromatic content of about 10 mass %. C13-C16 alkanes mainly include C13-C16 normal alkanes, C13-C16 isoalkanes and C13-C16 cycloalkanes.

Heavy oil component: waste engine oil

Catalytic component/light oil component=100% (mass ratio), The closed cup flash point of blended oil is higher than 47° C. According to the total mass of the final liquid fuel composition, the heavy oil component, light oil component and catalytic component are 60 mass %, 20 mass % and 20 mass %, respectively. The liquid fuel composition of the present application is obtained, and the closed flash point is greater than 48° C. according to the total mass of the final liquid fuel composition. The final liquid fuel mixture can contain 0-15 mass % aromatics.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

Example 4

As the light oil component and a catalytic component, they are the same as those in example 1, but the heavy oil component is restaurant waste oil (gutter oil), and the catalytic component/light oil component=87.5% (mass ratio). The closed cup flash point of the blended oil is higher than 47° C., according to the total mass of the final liquid fuel composition, the heavy oil component is 10 mass %, the light oil component is 48 mass %, and the catalytic component is 42 mass %. The liquid fuel composition of the present application is obtained, and its closed cup flash point is greater than 48° C. The final liquid fuel mixture can contain 0-15 mass % aromatics, and aromatics can contain toluene/xylene/ethylhenzene/propylbenzene/butylbenzene/pentylbenzene.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

Example 5

As the component of light oil and catalytic component, they are the same as that of embodiment 2, but the heavy oil component is jatropha curcas oil. According to the total mass of the final liquid fuel composition, the heavy oil component is 70 mass %, the light oil component is 0 mass %, the catalytic component is 30 mass %, and the liquid fuel composition is mixed. The liquid fuel composition of the present application is determined to could have a closed cup flash point of more than 85° C. The final liquid fuel mixture can contain 0-15 mass % aromatics, and the mixed aromatics can contain toluene/xylene/ethylbenzene/propylbenzene/hutylhenzene/pentylbenzene.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

Example 6

The components of light oil component and catalytic component are the same as those of embodiment 3, but the heavy oil component is biodiesel. According to the total mass of the final liquid fuel composition, 70 mass % of the heavy oil component, 0 mass of the light oil component and 30 mass % of the catalytic component are mixed to obtain the liquid fuel composition of the present application, and the closed cup flash point could be greater than 85° C. The final liquid fuel mixture can contain 0-15 mass % aromatics, and the mixed aromatics can contain toluene/xylene/ethylbenzene/propylbenzene/butylbenzene/pentylbenzene.

The liquid fuel was ignited in the cylinder, and the simulated combustion experiment was carried out. The obtained heat release curve of cylinder pressure shows a smooth single peak curve, which indicates that the liquid fuel gasifies smoothly and has no knock phenomenon during combustion.

The close cup flash points of the liquid fuel composition of examples 1-6 are shown in Table 1.

TABLE 1

| Examples | Flash points |
|---|---|
| 1 | More than 48° C. |
| 2 | More than 48° C. |
| 3 | More than 48° C. |
| 4 | More than 48° C. |
| 5 | More than 85° C. |
| 6 | More than 85° C. |

What is claimed is:

1. A liquid fuel comprises light oil component composed of C6-C12 alkanes, catalytic component composed of C13-C16 alkanes, and heavy oil component; On the basis of the liquid fuel, the mass fraction of the heavy oil component is 10%-90%, the mass fraction of the light oil component is 0%-49%, the mass fraction of the catalytic component is 10%-90%, and the mass of the catalytic component accounts for 86% or more of the mass of the light oil component; and the liquid fuel may also contain an aromatic hydrocarbon having a mass fraction of 0%15%.

2. The liquid fuel according to claim 1, wherein the mass content of the heavy oil component is 30%-90% based on total mass of the liquid fuel.

3. The liquid fuel according to claim 1, wherein the mass content of the light oil component is 5%-49% based on total mass of the liquid fuel.

4. The liquid fuel according to claim 1, wherein the closed cup flash point of the light oil component mixed with the catalytic component is not lower than 47° C.

5. The liquid fuel according to claim 1, wherein the closed cup flash point of the liquid fuel is not lower than 48° C.

6. The liquid fuel according to claim 5, wherein the closed cup flash point of the liquid fuel is not less than 55° C.

7. The liquid fuel according to claim 1, wherein the mass of the catalytic component accounts for 86%-1000% of the mass of the light oil component.

8. The liquid fuel according to claim 7, wherein the mass of the catalytic component accounts for 86%-500% of the mass of the light oil component.

9. The liquid fuel according to claim 8, wherein the mass of the catalytic component accounts for 100%-500% of the mass of the light oil component.

10. The liquid fuel according to claim 9, wherein the mass of the catalytic component accounts for 300%-500% of the mass of the light oil component.

11. The liquid fuel according to claim 1, wherein the heavy oil component includes waste engine oil, biodiesel, biological oil and its derivatives or a combination of two or more.

12. The liquid fuel according to claim 11, wherein the biological oil and its derivatives include animal or plant oil and its derivatives, and/or restaurant waste oil.

13. The liquid fuel according to claim 1, wherein the light oil component composed of alkanes of C6-C12 comprises a single alkane with 6-12 carbons or a mixture of more than one of them.

14. The liquid fuel according to claim 13, wherein the light oil component composed of alkanes of C6-C12 comprises one or more of normal alkanes with 6-12 carbons and isoalkanes with 6-12 carbons and cycloalkanes with 6-12 carbons.

15. The liquid fuel according to claim 1, wherein the catalytic component composed of alkanes of C13-C16 comprises a single alkane with 13-16 carbons or a mixture of more than one of them.

16. The liquid fuel according to claim 15, wherein the catalytic component composed of alkanes of C13-C16 comprises one or more of normal alkanes with 13-16 carbons and isoalkanes with 13-16 carbons and cycloalkanes with 13-16 carbons.

17. The use of liquid fuel as diesel engine fuel according to claim 1; wherein the liquid fuel has a cetane number of more than 40, which is used as a high-speed diesel engine fuel; the cetane number of the liquid fuel is more than 30, which is used as a medium-speed diesel engine fuel; or, the cetane number of the liquid fuel is lower than 30, which is used for the low-speed diesel engine fuel.

18. The use of the liquid fuel described in claim 1 as fuel for diesel/heavy oil combustion system, and as an alternative fuel to aviation jet turbine fuel, vehicle diesel or aviation kerosene.

* * * * *